US012630388B1

(12) United States Patent
Pavao

(10) Patent No.: US 12,630,388 B1
(45) Date of Patent: May 19, 2026

(54) CABLE WRAPPING DEVICE

(71) Applicant: SimpliSafe, Inc., Boston, MA (US)

(72) Inventor: Victor Pavao, Tyngsboro, MA (US)

(73) Assignee: SimpliSafe, Inc., Boston, MA (US)

( * ) Notice: Subject to any disclaimer, the term of this patent is extended or adjusted under 35 U.S.C. 154(b) by 0 days.

(21) Appl. No.: 19/196,185

(22) Filed: May 1, 2025

Related U.S. Application Data

(60) Provisional application No. 63/756,408, filed on Feb. 10, 2025.

(51) Int. Cl.
*B65H 75/28* (2006.01)
*B65H 75/08* (2006.01)
*B65H 75/50* (2006.01)

(52) U.S. Cl.
CPC ..... *B65H 75/28* (2013.01); *B65H 75/08* (2013.01); *B65H 75/50* (2013.01); *B65H 2701/34* (2013.01)

(58) Field of Classification Search
CPC ..... B65H 75/00; B65H 75/02; B65H 75/025; B65H 75/04; B65H 75/06; B65H 75/08
See application file for complete search history.

(56) References Cited

U.S. PATENT DOCUMENTS 10,179,691 B2 * 1/2019 McCarren ..... B65H 55/00
2017/0088392 A1 * 3/2017 Wang ..... B65B 5/04

* cited by examiner

*Primary Examiner* — Javier A Pagan
(74) *Attorney, Agent, or Firm* — Morgan, Lewis & Bockius LLP

(57) ABSTRACT

A cable wrapping device includes a body that includes opposed terminal edges. A first adhesive layer is disposed on a portion of the body proximate one of the opposed terminal edges thereof. An arm is positioned between the opposed terminal edges of the body and extends in a lateral direction away from the body. The arm includes a second adhesive layer disposed on the arm proximate a terminal end of the arm.

18 Claims, 8 Drawing Sheets

CABLE WRAPPING DEVICE

CROSS-REFERENCE TO RELATED APPLICATIONS

This application claims the benefit of U.S. Provisional Patent Application No. 63/756,408 filed Feb. 10, 2025 entitled "Cable Wrapping Device", which is incorporated by reference herein in its entirety.

BACKGROUND

Cables are conventionally retained using twist-ties, cable packaging, cable drums, cable spools, and the like in a variety of industries and products. Some such devices are included in consumer products and used to retain cables in desired configurations and/or positions within a packaging container including the consumer product.

SUMMARY

In one example there is a cable wrapping device including a body including opposed terminal edges and a first adhesive layer disposed on a portion of the body proximate one of the opposed terminal edges thereof, and an arm positioned between the opposed terminal edges of the body and extending in a lateral direction away from the body, the arm including a second adhesive layer disposed on the arm proximate a terminal end of the arm.

In some examples, the arm has a width as measured in the lateral direction that is at least twice a width of the body. In some examples, the arm extends laterally from a top edge of the body and a flap aligned with the arm extends laterally away from a bottom edge of the body. In some examples, the body and the arm are integrally formed. In some examples, the body is comprised of a corrugated material. In some examples, the body is comprised of a paperboard material. In some examples, the arm has a width that is at least twice a width of the body. In some examples, the body has a width of between about 40 mm to about 50 mm and a length of between about 200 mm to about 300 mm, and the arm has a width of between about 80 mm to about 100 mm and a length of between about 10 mm to about 30 mm. In some examples, the arm includes a plurality of arms individually coupled to and extending laterally away from the body, at least one the plurality of arms offset from one another in a longitudinal direction, and the second adhesive layer is disposed on a portion of each of the plurality of arms.

In one example there is a packaged cable assembly including a cable wrapping device including a body having a plurality of surfaces, and first and second terminal edges opposite one another, the one surface at the second terminal edge being adhered to another surface at the first terminal edge such that the body forms a cylindrical shape, and an arm positioned between the opposed first and second terminal edges and extending in a lateral direction away from the body, and a cable positioned around and at least partially abutting the body and the arm is adhered to the body.

In some examples, the cable is a power cable. In some examples, an inner surface of the body defines a sidewall of an aperture that extends circumferentially about a lateral axis. In some examples, the body and arm are integrally formed.

In another example there is a method including folding a cable wrapping device such that a body thereof forms a substantially cylindrical shape, adhering a portion of a surface of the body to another portion thereof, coiling a cable around one surface of the body, folding an arm that extends laterally from the body around the coiled cable such that the cable is positioned between the arm and the one surface of the body, and adhering an end of the folded arm to the body.

In some examples the method further includes folding a flap that extends laterally away from the body opposite the arm towards the arm, and folding the arm around the coiled cable includes folding the arm around the folded flap. In some examples, the arm is a first arm and the method further includes folding a second arm that extends laterally from the body around the coiled cable such that the cable is positioned between the second arm and the one surface of the body. In some examples the method further includes folding a third arm that extends laterally from the body around the coiled cable such that the cable is positioned between the third arm and the one surface of the body, and the first arm, second arm and third arm are spaced from one another along the body.

In some examples, adhering a portion of a surface of the body to another portion thereof further includes adhering a portion of an exterior surface of the body at one end thereof to a portion of an inner surface of the body at an opposite end thereof. In some examples, folding an arm around the coiled cable further includes folding the arm downward from a top edge of the body toward a bottom edge thereof at a front surface of the body and wrapping the arm around the bottom edge such that the end of the arm is positioned at an inner surface between the top and bottom edges. In some examples, coiling the cable around one surface of the body includes coiling the cable around an outer surface of the body, and adhering the end of the folded arm to the body includes adhering the end of the folded arm to the inner surface of the body opposite the outer surface.

In another example there is a a cable wrapping device including a body including opposed terminal edges and a first adhesive layer disposed on a portion of the body proximate one of the opposed terminal edges thereof, and a pair of interlocking arms coupled to the body at opposed top and bottom edges thereof, the pair of interlocking arms including a slit extending partially along a length thereof to interlock the arms with one another.

BRIEF DESCRIPTION OF THE DRAWINGS

The foregoing summary, as well as the following detailed description of examples of the cable wrapping device, will be better understood when read in conjunction with the appended drawings of examples. It should be understood, however, that the claims are not limited to the precise arrangements and instrumentalities shown.

In the drawings.

DETAILED DESCRIPTION

Figure 1:
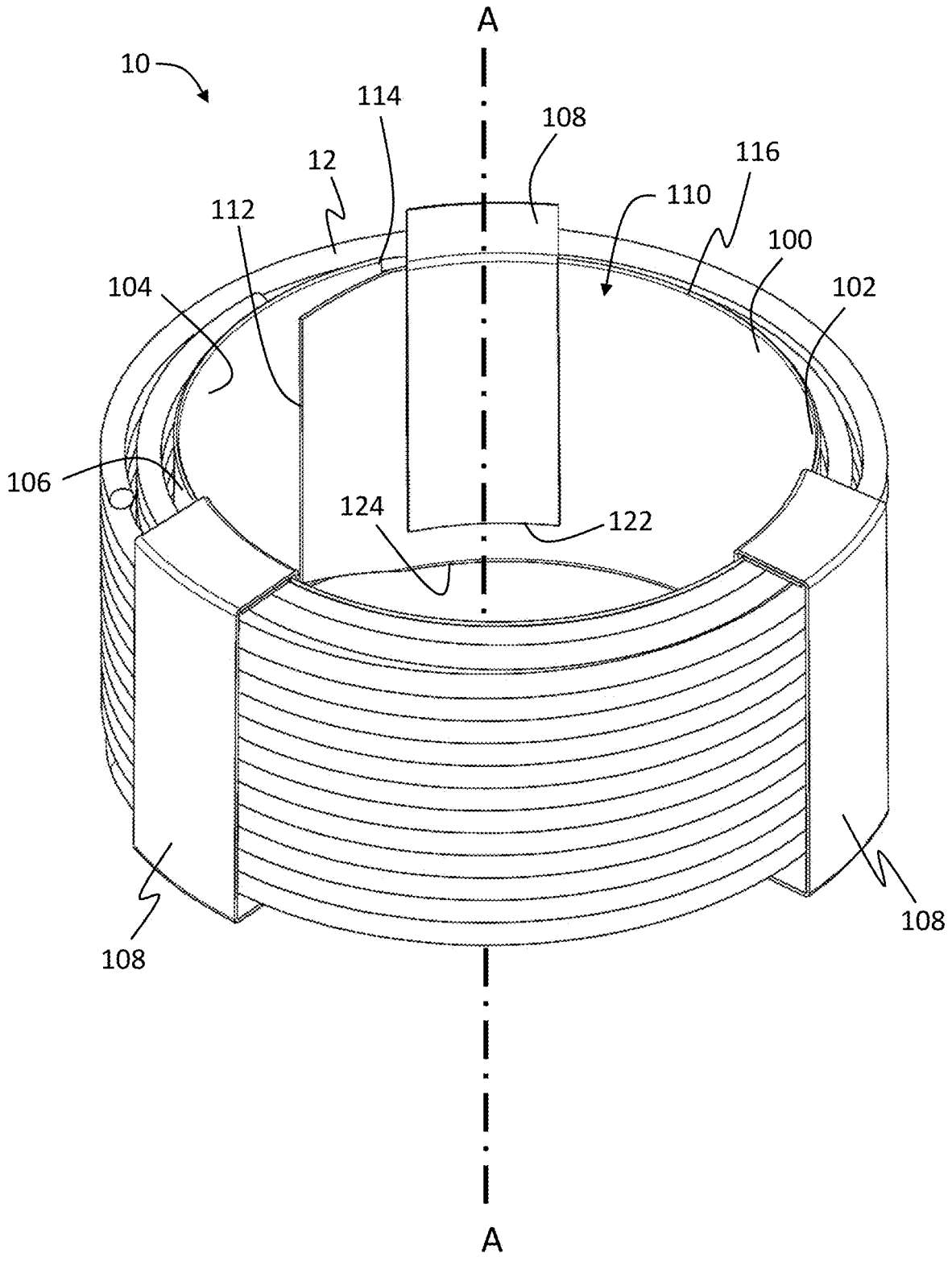
FIG. 1 is a perspective view of a packaged cable assembly including a cable wrapping device and in accordance with the present disclosure.

In one exemplary application, a cable wrapping device may be used to retain a cable in a wrapped or bundled configuration. Cable wrapping devices may be used for the storage and/or transport of cables, ropes, or the like. In one exemplary application, a cable wrapping device may be included in a packaged product as a packaging insert. Conventional cable wrapping devices are often bulky and/or fail to adequately retain cables in a desired configuration. For example, cables (e.g., power cables, data cables), or the like, are conventionally bound by twist ties or rubber bands, which can cause the cable to bend excessively, resulting in damage to the cable. Cables are also conventionally wrapped around cable drums that are often bulky and fail to securely fasten the cable thereto. Such cable wrapping devices may also be included in packaging containers within which other components or products may be placed. In such instances the available volume within the packaging container may be reduced due to the bulky and oversized shaped of the packaged cable. In some cases, the product packaging may need to increase in size to accommodate cable packaging. Increased packaging size is problematic because additional packaging materials (e.g., internal packaging such as foam or air cushion bags or external packaging such as cardboard) are required, leading to more packing waste, which is harmful to the environment.

In accordance with exemplary aspects of the present disclosure, there is a cable wrapping device configured to securely retain a cable in a desired configuration. The cable wrapping device as disclosed herein may be configured to retain a cable without damaging the cable. The cable wrapping device of the present disclosure may be configured to securely fasten a cable thereto while minimizing the overall volume of the wrapped cable and cable wrapping device. The cable wrapping device of the present disclosure may be configured to be included in a packaging container without requiring additional packaging materials and/or an increase in size of the packaging container.

Referring to the drawings in detail, wherein like reference numerals indicate like elements throughout, there is shown in FIGS. 1-4 a cable wrapping device, generally designated 100, in accordance with an exemplary example of the present disclosure. In some examples, the cable wrapping device 100 is configured to securely retain a cable, cord, wire, rope, or the like, therein such that the cable wrapping device and cable maybe securely positioned within a packaging container. In some examples, the cable wrapping device 100 is configured to retain a cable therein and define a space therethrough within which one or more other items included in a packaged product may be placed. In some examples, the cable wrapping device may be a cable retainer or cable drum.

Referring to FIG. 1, a cable assembly, generally designated 10, including the cable wrapping device 100 of the present disclosure, is shown. In FIG. 1, the cable wrapping device 100 is illustrated in a use configuration in which a cable 12 is coiled around the cable wrapping device 100. The cable wrapping device 100 may include a longitudinal body 102 having an inner surface 104 and an outer surface 106. In some examples, the body 102 (e.g., a longitudinal body) is configured to provide a surface around which the cable 12 may be coiled. For example, the body 102 may be configured to form a generally cylindrical structure (e.g., as illustrated in FIG. 1) around which the cable 12 may be coiled.

In some examples, the cable wrapping device 100 may include one or more arms 108 coupled to the body 102. The arms 108 may be configured to retain the cable 12 against or substantially adjacent to the body 102. For example, the arms 108 are configured to wrap around the coiled cable 12 thereby retaining the cable 12 between the body 102 and arms 108. In some examples, the cable wrapping device 100 includes three arms 108 each spaced from one another along the body 102, as illustrated in FIG. 1. The arms 108 may be spaced generally equidistant from one another. In some examples, the arms 108 may be spaced asymmetrically from one another. In some examples, the cable wrapping device 100 includes at least two arms 108. In some examples, the cable wrapping device 100 includes one arm 108, two arms 108, three arms 108, four arms 108, five arms 108 or more than five arms 108. In some examples, each of the arms 108 is generally the same the others. For example, the arms 108 may each have generally the same size, shape, and appearance, and/or be comprised of the same material. In some examples, the arms 108 are comprised of the same material as the longitudinal body 102.

In some examples, the inner surface 104 of the body defines a sidewall of an aperture 110 that extends generally circumferentially about a lateral axis A. For example, when the cable wrapping device 100 is in the use configuration the body 102 is formed into a generally cylindrical shape such that aperture 110 is formed by the inner surface 104. In some examples, the aperture 110 is devoid of the cable 12. For example, when retained by the cable wrapping device 100 the cable 12 is sandwiched between the outer surface 106 of the body 102 and the arms 108 such that the cable 12 does not extend into the aperture 110. Accordingly, the aperture 110 may be generally free to receive other products and/or packaging components that are packaged along with the packaged cable assembly 10.

In other examples, the cable 12 may be positioned within the aperture 110. In such examples, the cable 12 may be wrapped around the inner surface 104 and the arms 108 may secure the cable 12 to the wrapping device 100. For example, the arms 108 may extend through the aperture and sandwich the cable 12 between the inner surface 104 and the arms 108.

Figure 4:
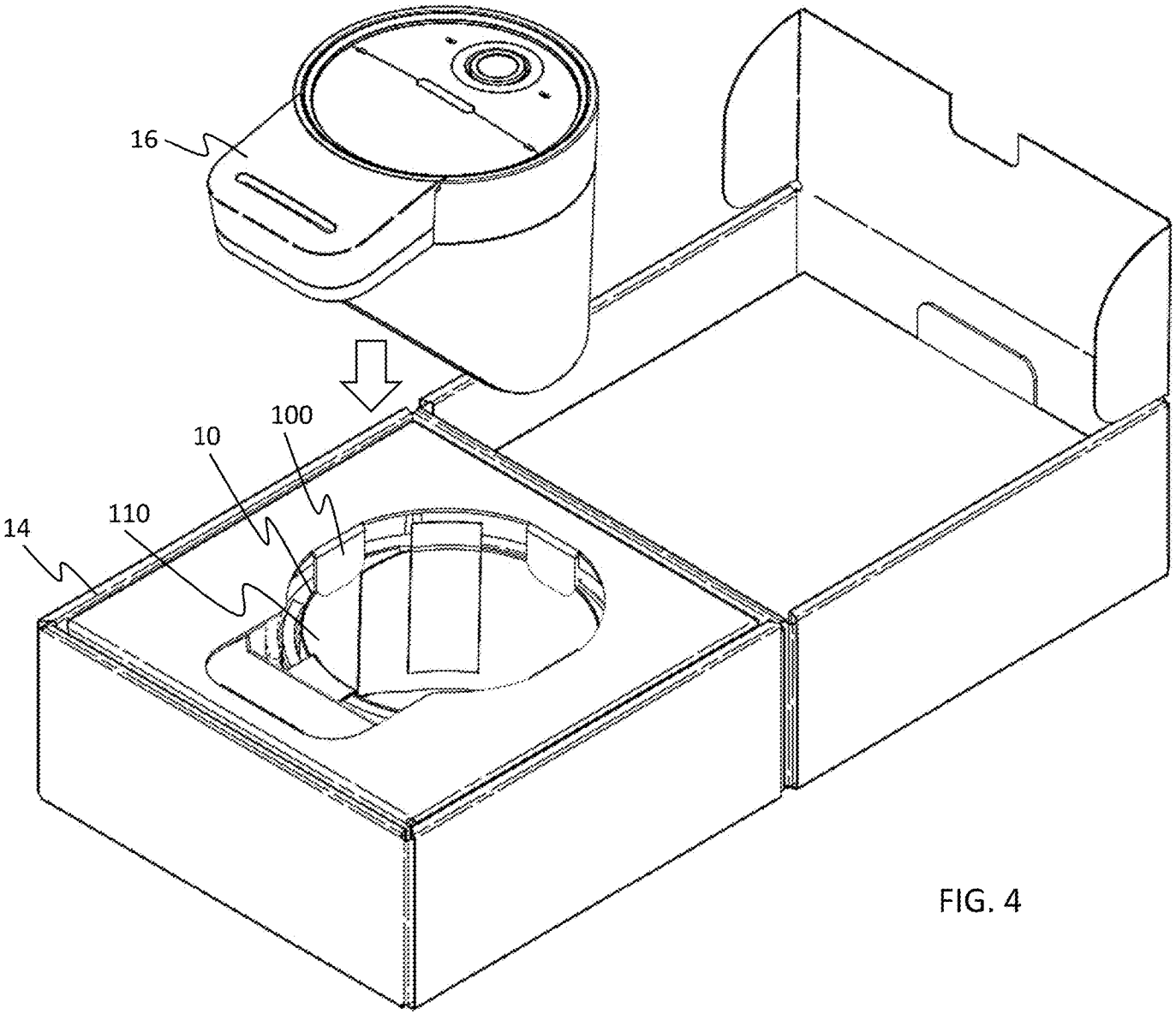
FIG. 4 is a perspective view of the packaged cable assembly of FIG. 1 in use with a packaging container.
Figure 5:
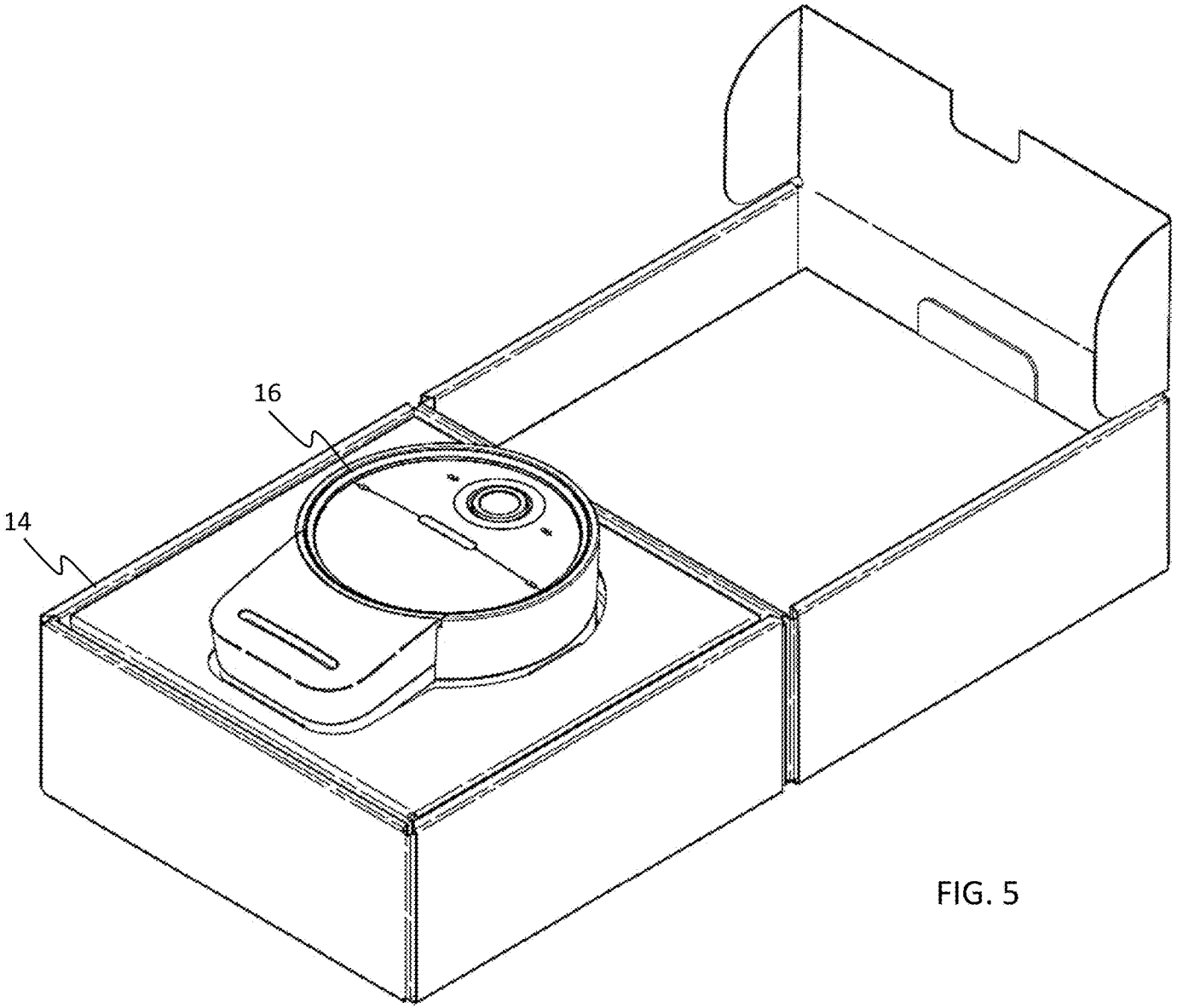
FIG. 5 is a perspective view of the packaging container of FIG. 4.

In some examples, and referring briefly to FIGS. 4-5, the cable wrapping device 100 may be included in a packaging container 14 as a packaging insert. In FIGS. 4-5, there is illustrated a packaging container 14 within which the packaged cable assembly 10 and cable wrapping device 100 of the present disclosure are housed. As illustrated in FIG. 4, the packaging container 14 encloses the cable wrapping device 100 positioned therein and a product 16 (e.g., a camera) is positioned above the aperture 110 defined by the cable wrapping device 100. As illustrated by the arrow in FIG. 4, the product 16 may be placed within the packaging container 14 such that at least a portion of it extends through the aperture 110, as illustrated in FIG. 5. In the example in FIGS. 4-5, the product 16 is a home security camera with a generally cylindrical body, however it should be understood that a variety of other products having a variety of shapes may be placed within the packaging container 14 such that they extend at least partially through the aperture 110.

Figure 2:
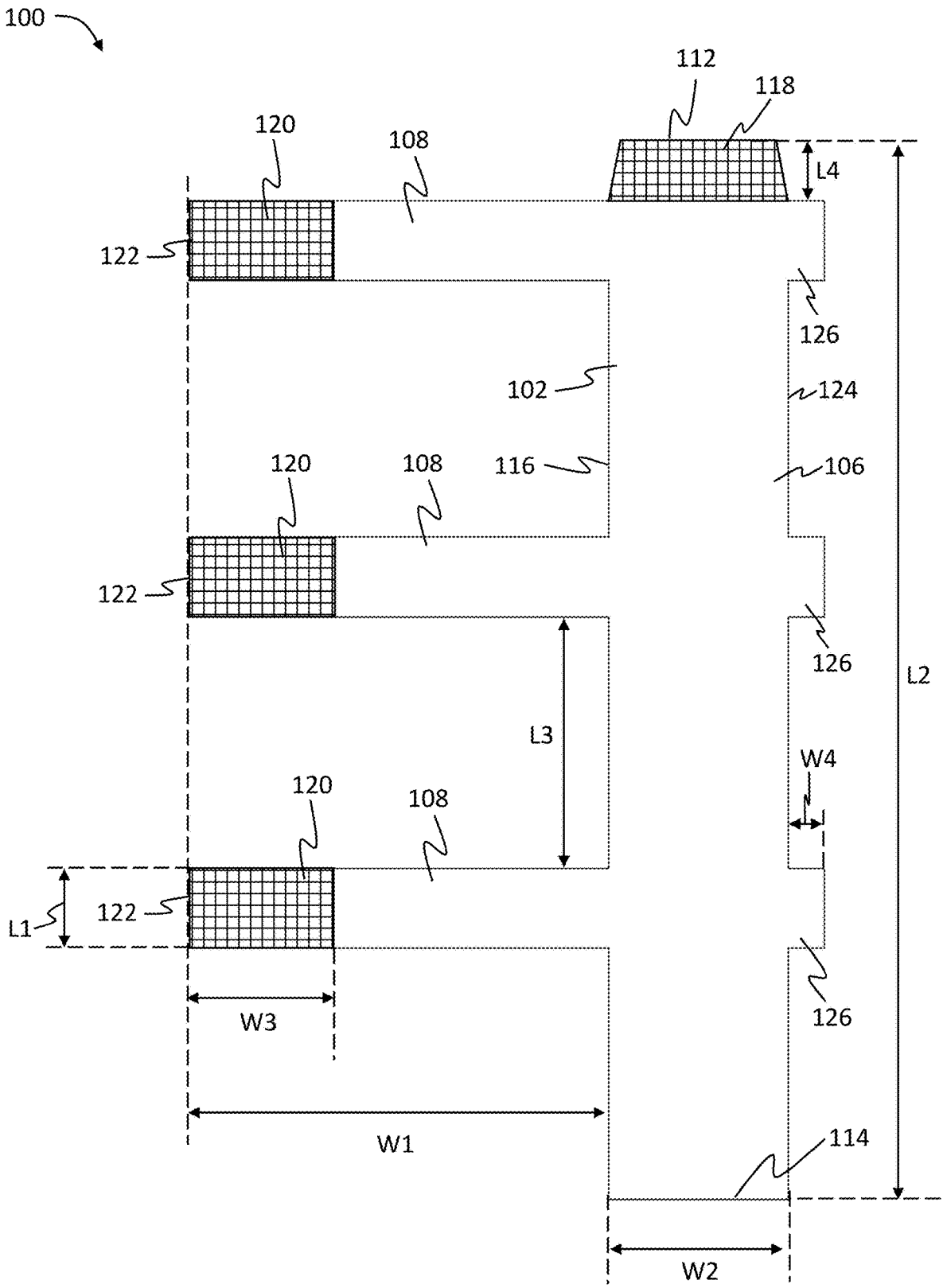
FIG. 2 is a front elevational view of the cable wrapping device of FIG. 1 in a flat, pre-folded configuration.
Figure 3:
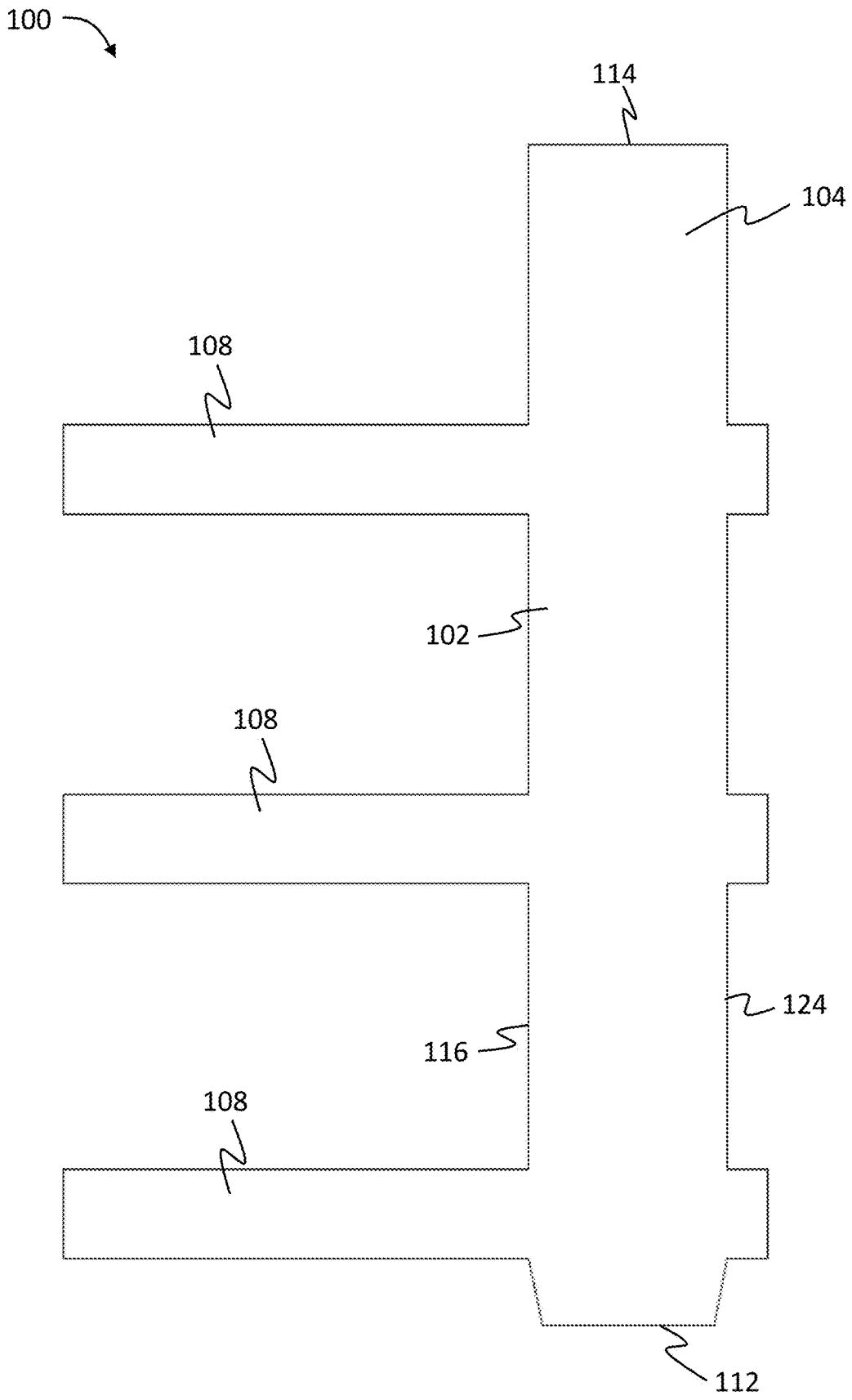
FIG. 3 is a rear elevational view of the cable wrapping device of FIG. 1 in a flat, pre-folded configuration.

Referring to FIGS. 2-3, the cable wrapping device 100 is shown in a flat configuration. In some examples, the cable wrapping device 100 may be provided in the flat configuration prior to being transitioned or otherwise shaped into the configuration illustrated in FIG. 1. The body 102 may be configured to be transitioned into the configuration illustrated in FIG. 1 by overlapping opposed terminal ends of the body 102. The body 102 may include a first terminal end 112 and a second terminal end 114 opposite the first terminal end 112. The arm(s) 108 may be positioned between the terminal ends 112, 114 and extend in a lateral direction away from the longitudinal body 102. In some examples, the arms 108 extend laterally from a top edge 116 of the longitudinal body 102. For example, the arms 108 may be coupled to the top edge 116 of the longitudinal body 102 and extend away therefrom in a lateral direction.

The arms 108 and body 102 may be a unitary construct. In some examples, the arms 108 and body 102 of the cable wrapping device 100 are cut from the same sheet of material. For example, a series of cuts may be performed on a sheet of paperboard material such that the body 102 and arms 108 are formed as a unitary construct. In some examples, the longitudinal body 102 and/or arms 108 are comprised of a generally pliable material such that each may be bent and/or contoured to a desired shape (e.g., the shape of the use configuration). In some examples, the longitudinal body 102 and/or arms 108 are comprised of a corrugated material. In some examples, the longitudinal body 102 and/or arms 108 are comprised of a paperboard material. In some examples, the longitudinal body 102 and/or arms 108 are comprised of a solid bleached sulfate (SBS) paperboard material. In some examples, the longitudinal body 102 and/or arms 108 are comprised of a folding box board (FBB) paperboard material.

In some examples, the cable wrapping device 100 includes one or more adhesive layers configured to enable the cable wrapping device 100 to be manipulated or otherwise arranged (e.g., as illustrated in FIG. 1). The cable wrapping device may include a first adhesive layer 118 disposed on a portion of the body 102 proximate one of the terminal edges 112, 114 and a second adhesive layer 120 disposed on the arm(s) 108 proximate a terminal end thereof. In FIG. 2 the adhesive layers 118 and 120 are illustrated by the cross-hatched areas. In some examples, individual adhesive layers 118, 120 are disposed on the same surface of the cable wrapping device 100. For example, and as illustrated in FIGS. 2-3 the adhesive layers 118, 120 are disposed on the outer surface 106. The inner surface 104 may be devoid of any adhesive layer disposed thereon while the cable wrapping device 100 is in the flat configuration. By providing a surface (e.g., inner surface 104) generally devoid of an adhesive, other products, devices and/or components thereof may be placed against or proximate to the cable wrapping device 100 without being adhered thereto. For example, when the cable wrapping device 100 is used as a packaging insert, as discussed above with regard to FIGS. 4-5, the aperture 110 is substantially devoid of an exposed adhesive, thereby reducing the risk of product 16 accidentally adhering to the cable wrapping device 100.

Referring to FIGS. 1-2, the first adhesive layer 118 may be configured to retain the body 102 in the generally cylindrical shape while in the use configuration. As discussed above, the body 102 may be comprised of a generally pliable material such that the body 102 may be contoured into a generally cylindrical shape (e.g., as illustrated in FIG. 1). The body 102 may be contoured into the generally cylindrical shape and the first adhesive layer 118, proximate terminal edge 112, may contact the inner surface 104 proximate the second terminal edge 114. Contact of the adhesive layer 118 with the inner surface 104 may adhere the first terminal edge 112 to the inner surface 104 such that the body 102 is retained in the generally cylindrical shape corresponding to the use configuration.

The second adhesive layer 120 may be applied to the arm(s) 108 proximate a terminal edge 122 thereof and configured to attach or otherwise secure the terminal edge 122 to the body 102. The arm(s) 108 may be comprised of a generally pliable material, as discussed above, such that they may be bent to wrap around the cable 12 and adhere to the inner surface 104 of the body 102 (e.g., as illustrated in FIG. 1). When bent or otherwise positioned to wrap around the cable 12 the arm(s) 108 may be folded such that a portion devoid of any adhesive layer faces the outer surface 106 of the body 102 and the portion including the second adhesive layer 120 faces the inner surface 104. For example, and as illustrated in FIG. 1, the arm(s) 108 are bent four times such that the cable 12 is sandwiched between the outer surface 106 of the longitudinal body 102 and the portion of the arm(s) 108 devoid of an adhesive layer. When coupled to the cable wrapping device 100 the cable 12 may not be in direct contact with the adhesive layers 118, 120 thereby preventing any adhesive residue or residuals from being deposited onto the cable 12. In other examples, the first adhesive layer 118 and/or second adhesive layer 120 may be replaced with a one half of a hook and loop fastener configured to detachably couple to the remaining half that may be disposed on the body 102 (e.g., at the inner surface 104 or outer surface 106). In other examples, the adhesive layers 118 and/or 120 may be replaced with a button fastener, a latch, or another suitable fastener configured to engage with the body 102.

When arranged around the cable 12, the second adhesive layer 120 disposed on the arm(s) 108 may contact the inner surface 104 thereby adhering a portion of the arm(s) 108 to the inner surface 104. Accordingly, the arm(s) 108 may be retained in a fashion, in which they wrap around the cable 12, via the second adhesive layer 120. For example, and as illustrated in FIG. 1, the terminal edge 122 of the arm(s) 108 contacts the inner surface 104 and is adhered thereto via the second adhesive layer 120. In some examples, individual arms 108 include a corresponding second adhesive layer 120. The adhesive layers 118, 120 may be comprised of any adhesive suitable for adhering to the material of the longitudinal body 102 and/or arms 108.

In some examples, the arms 108 are sized to wrap around the longitudinal body 102 and be adhered thereto at the inner surface 104. The arms 108 may have a width W1 as measured in the lateral direction that is at least twice the width W2 of the longitudinal body 102. In some examples, the width W1 is between about twice the width W2 and about three times the width W2. In some examples, the width W1 of the arms 108 is configured to enable the arms 108 to be wrapped around a cable 12 such that the terminal edge 122 of the arms 108 terminates at the inner surface 104 of the longitudinal body 102. For example, and as illustrated in FIG. 1, the width W1 is selected such that the terminal edge contacts the inner surface 104 between the top edge 116 and a bottom edge 124 of the longitudinal body 102.

In some examples, the arms 108 have a length L1, as measured in a longitudinal direction. The length L1 may be less than the width W1. In some examples, the length L1 may be between about 20% to about 50% of the width W1. The length L1 of the arms 108 may be between about 10 mm to about 30 mm. In some examples, the length L1 of the arms is about 20 mm. In some examples, the adhesive layer 120 extends along the length L1 of the arms 108 and along a portion of the width W1 by a width W3. In some examples, the width W3 of the adhesive layers 120 is between about 30% to about 50% of the width W1 of the arms 108. In some examples, the width W1 of the arms 108 is between about 80 mm to about 100 mm. In some examples, the width W1 of the arms 108 is about 95.5 mm. In some examples, the width W3 of the adhesive layers 120 is between about 30 mm to about 50 mm. In some examples, the width W3 of the adhesive layers 120 is about 40 mm.

In some examples, the body 102 has a total length L2 as measured in the longitudinal direction. In some examples, the length L2 of the body 102 is between about 200 mm to about 300 mm. In some examples, the length L2 of the body 102 is between about 220 mm to about 280 mm. In some examples, the length L2 of the body 102 is about 265 mm. In some examples, the width W2 of the body 102 is between about 30 mm to about 60 mm. In some examples, the arms 108 are spaced from one another along the body 102 in the longitudinal direction at intervals of a length L3. In some examples, the length L3 is between about 50 mm to about 80 mm. In some examples, the length L3 is between about 60 mm to about 70 mm. In some examples, the length L3 is about 63 mm.

In some examples, the width W2 of the body 102 is between about 40 mm to about 50 mm. In some examples, the width W2 of the body 102 is about 45 mm. In some examples, the first adhesive layer 118 has a width generally equal to the width W2 of the body 102. In other examples, the first adhesive layer 118 has a width less than the width W2 of the body 102. In some examples, the first adhesive layer 118 has a length L4 that is between about 10 mm to about 20 mm. In some examples the length L4 of the first adhesive layer 118 is about 15 mm.

In some examples, the cable wrapping device 100 includes flaps 126 configured to aid in retaining a cable 12 against the cable wrapping device 100. The flaps 126 may extend laterally from the bottom edge 124 of the body 102 away from the arms 108. In some examples, the flaps 126 are aligned with the arms 108. The cable wrapping device 100 may include a flap 126 for individual arms 108. The flaps 126 may be aligned with a corresponding arm 108 in the longitudinal direction of the body 102. For example, and as illustrated in FIG. 2, there are three flaps 126 aligned in the longitudinal direction with a corresponding one of the three arms 108. In some examples, the flaps 126 may be folded toward the outer surface 106 of the body 102 when the cable wrapping device 100 is in the use configuration and act as a retaining surface along the bottom edge 124 for the cable 12. The arms 108, when folded in such a fashion, may wrap around the corresponding flaps 126 and adhere to the inner surface 104 of the body 102 as discussed above. In some examples, the flaps 126 are integrally formed with the body 102. In some examples, the flaps 126 have the same length as the arms 108. For example, the flaps 126 have a length equal to the length L1. In other examples, the flaps 126 have a length that is less than the length L1. In some examples, the flaps 126 have a width W4 of between about 5 mm to about 15 mm. In some examples, the flaps 126 have a width W4 of about 10 mm.

Figure 6:
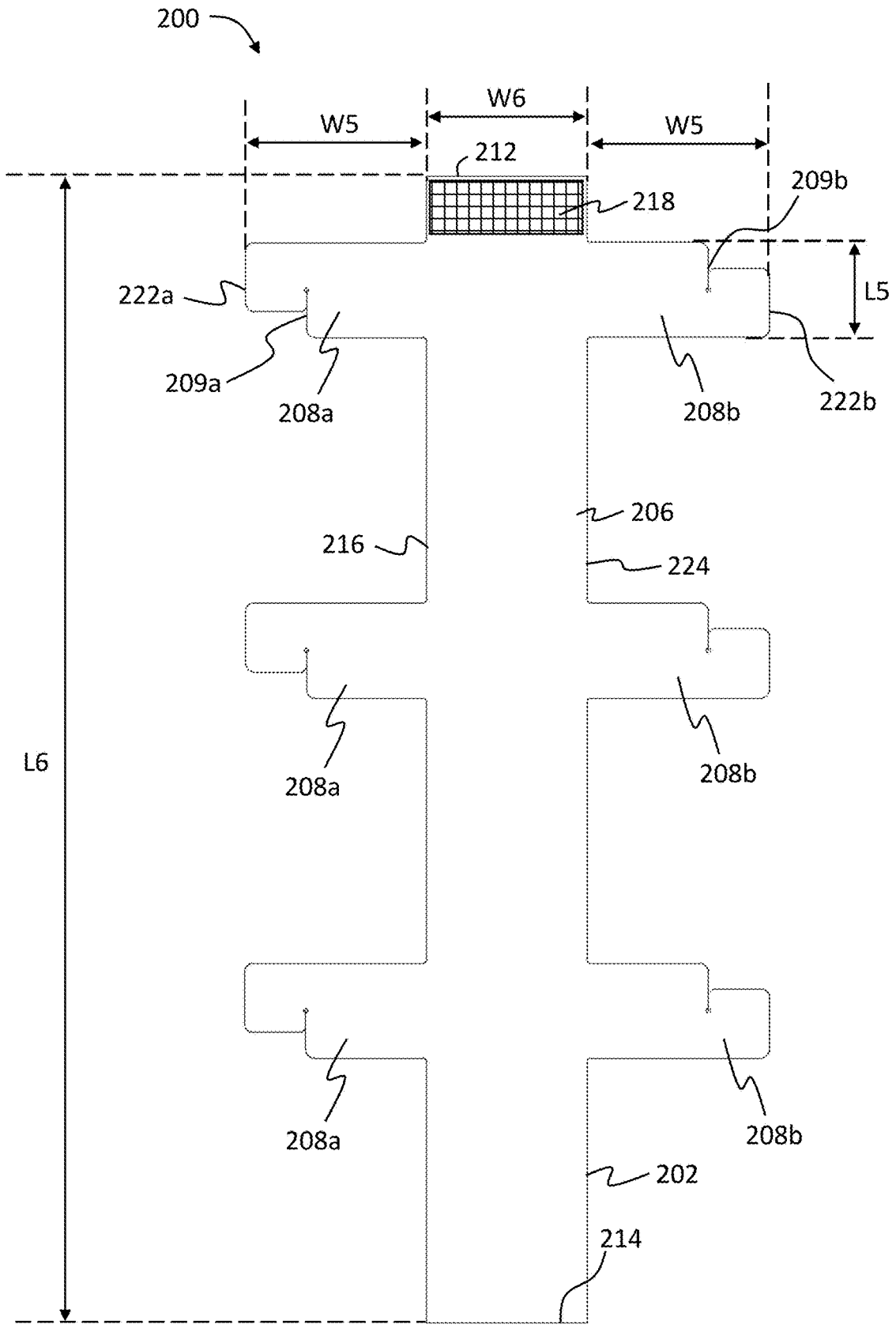
FIG. 6 is a front elevational view of a cable wrapping device in accordance with the present disclosure.

Referring to FIG. 6, there is shown a cable wrapping device, generally designated 200 in accordance with another example of the present disclosure. The cable wrapping device 200 may be generally the same as cable wrapping device 100 except that it may include one or more interlocking arms 208*a*, 208*b* configured to retain a cable. The arms 208*a*, 208*b* may be coupled to a body 202 of the cable wrapping device 200 in generally the same manner as arms 108 to body 102 as discussed above. For example, the arms 208*a*, 208*b* are integrally formed with the body 202 and protrude outwardly therefrom. The body 202 may be substantially the same as body 102 as discussed above. In some examples, the body 202 includes opposed terminal ends 212, 214 and a first adhesive layer 218 disposed at one of the terminal ends 212, 214. The adhesive layer 218 may be substantially the same as adhesive layer 118. For example, the adhesive layer 218 is disposed at the outer surface 206 of the body 202 at the first terminal end 212 thereof. The adhesive layer 218 may be configured to retain the body 202 in a generally cylindrical shape in generally the same manner as described above for cable wrapping device 100. For example, the body 202 may be folded into a cylindrical shape such that the adhesive layer 218 adheres to the body 202 at the opposite terminal end thereof. In FIG. 6, a surface (e.g., outer surface 206) of the cable wrapping device 200 is illustrated and the opposite surface thereof (e.g., an inner surface) may be a mirror image of what is shown in FIG. 6 except that, in some examples, it may be devoid of an adhesive layer.

In some examples, the arms 208*a*, 208*b* are aligned with one another in the longitudinal direction and positioned at opposite sides of the body 202. There may be a first arm 208*a* protruding from the top edge 216 of the body 202 and a second arm 208*b* protruding from the bottom edge 224 thereof. The arms 208*a*, 208*b* may be configured to retain a cable against the body 202 similar to the arm 108 discussed above. For example, when a cable is coiled about body 202, the arms 208*a*, 208*b* may be folded toward one another and interlocked with one another such that the cable is sandwiched or otherwise disposed in between the body 202 and arms 208*a*, 208*b*. In some examples, the arms 208*a*, 208*b* are configured to be interlocked with one another without the use of adhesives.

The arms 208*a*, 208*b* may include slits or openings 209*a*, 209*b* to receive arms 208*a*, 208*b* to interlock them with one another. For example, the arms 208*a*, 208*b* may be folded toward one another from what is shown in FIG. 6, and the slits 209*a*, 209*b* may be aligned and slotted into one another thereby interlocking the arms 208*a*, 208*b* to one another. Accordingly, the arms 208*a*, 208*b* may be retained in position or otherwise engaged with one another via slits 209*a*, 209*b*. In some examples, the interlocking feature of the arms 208*a*, 208*b* enables a user to easily engage and disengage the arms 208*a*, 208*b* from one another. For example, a user may slide the arms 208*a*, 208*b* relative to one another such that the slits 209*a*, 209*b* are no longer engaged with one another to disassemble the device 200. With the wrapping device 200 disassembled, the cable can be removed therefrom.

The slits 209*a*, 209*b* may be positioned between the body 202 and the terminal edge 222*a*, 222*b* of the corresponding arm 208*a*, 208*b*. In some example, the slits 209*a*, 209*b* are formed by making a cut, notch or other opening in the corresponding arm 208*a*, 208*b* that extends partially along the length L5 thereof. In some examples, individual arms 208*a*, 208*b* have the same length L5. In some examples, the length L5 is between about 10 mm to about 30 mm. In some examples, the length L5 of the arms 208*a*, 208*b* is about 20 mm. In some examples, the length L5 of the arms 208*a*, 208*b* is between about 5% to about 20% of the length L6 of the body 202. In some examples, the length L6 of the body 202 is between about 200 mm to about 300 mm. In some examples, the length L6 is about 265 mm.

In some examples, the arms 208*a*, 208*b* protrude from the body 202 by a generally equal distance. For example, the arms 208*a*, 208*b* may have a width W5 that is generally equal. In some examples, the width W5 is greater than a width W6 of the body 202. In some examples, the width W5 of the arms 208*a*, 208*b* is between about 10% to about 50% greater than the width W6 of the body 202. In some examples, the width W5 is about 15% greater than the width W6. In some examples, the width W5 is between about 35 mm to about 45 mm. In some examples, the width W5 is about 42 mm. In some examples, the width W6 is between about 20 mm to about 40 mm. In some examples, the width W6 is about 37 mm.

In some examples, the wrapping device 200 includes a plurality of interlocking arms 208*a*, 208*b*. The wrapping device 200 may include more than two pairs of interlocking arms 208*a*, 208*b*. For example, and as illustrated in FIG. 6, the cable wrapping device 200 includes three pairs of interlocking arms 208*a*, 208*b*. In some examples, each pair of interlocking arms 208*a*, 208*b* is substantially the same in size and shape as one another. In some examples, the pairs of interlocking arms 208*a*, 208*b* are offset in the longitudinal direction from adjacent pairs of interlocking arms. In some examples, the plurality of pairs of interlocking arms 208*a*, 208*b* are spaced generally equidistant from one another. In other examples, the plurality of pairs of interlocking arms 208*a*, 208*b* are unequally spaced from one another.

Figure 7:
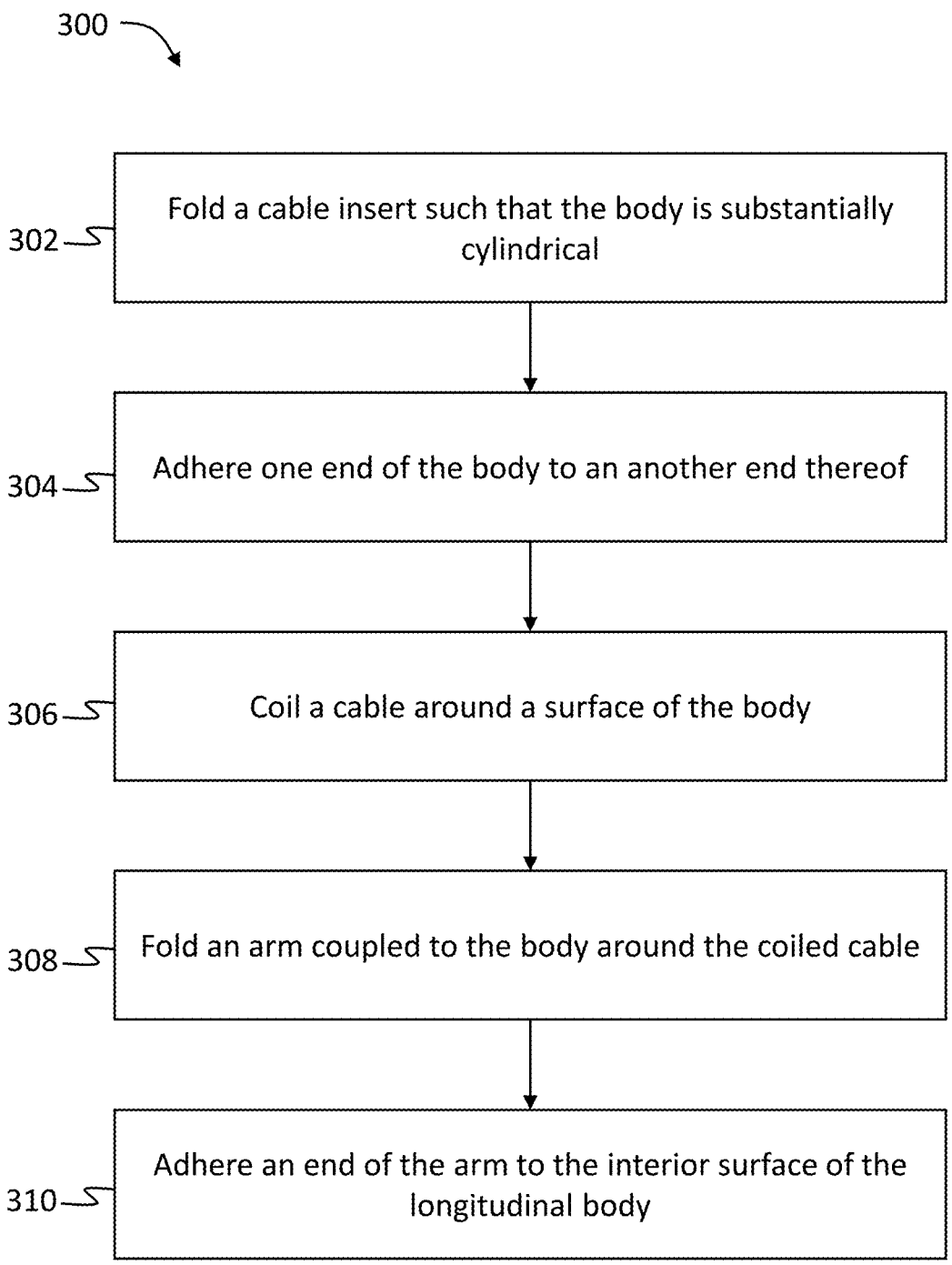
FIG. 7 is a flowchart illustrating a method of wrapping a cable in accordance with the present disclosure.

Referring to FIG. 7, there is illustrated a method, generally designated 300, of wrapping a cable in accordance with an exemplary example of the present disclosure. In some examples, the method 300 includes the step 302 of folding a cable insert such that a body thereof forms a substantially cylindrical-shape. For example, the body 102 of cable wrapping device 100 and/or body 202 of cable wrapping device 200 may be folded from the flat configuration (e.g., illustrated in FIG. 2) to wrap the body 102, 202 to receive coiled cabling (e.g., as illustrated in FIG. 1), as discussed above with regard to FIGS. 1-2 and 6. The method 300 may include the step 304 of adhering one end of the body to another or opposite end thereof. For example, and as discussed above with regards to FIGS. 1-2, the first adhesive layer 118 disposed at the first terminal end 112 is adhered to the second terminal end 114 of the longitudinal body thereby retaining the longitudinal body 102 in the generally cylindrical shaped structure. In some examples, the first adhesive layer 118 is adhered to the inner surface 104 proximate the second terminal end 114.

The method 300 may include the step 306 of coiling a cable around a surface of the body. For example, the cable 12, as illustrated in FIG. 1, may be coiled around or otherwise positioned about the outer surface 106 of the body 102 while the body 102 is in the generally cylindrical shape corresponding to the use configuration. In some examples, the step 306 is performed prior to folding the arms 108 around the cable 12. In some examples, one or more flaps are folded prior to the cable being coiled around or positioned about the body 102 in step 306. For example, the flaps 126 may be folded toward a surface of the body 102 prior to the cable 12 being coiled or otherwise positioned around the body 102. In such instances, the cable 12, when coiled around the body 102 may abut the folded flaps 126.

The method 300 may include the step 308 of folding an arm that extends laterally from the body around the coiled cable such that the cable is sandwiched between the arm and a surface of the body. For example, while the cable 12 is coiled around the outer surface 106 of the body 102 the arms 108 may be folded around the cable 12, as discussed above with regards to FIGS. 1-2. As another example, while the cable is coiled around the outer surface 206 of the body 202, the interlocking arms 208*a*, 208*b* may be folded toward one another, and around the cable such that the slits 209*a*, 209*b* engage one another thereby interlocking the arms 208*a*, 208*b* together, as discussed above. The method 300 may include the step 310 of attaching (e.g., adhering) an end of the folded arm to a surface of the body. For example, and as discussed above with regards to FIGS. 1-2, the terminal edge 122 of the arms 108 is adhered to the inner surface 104 of the body 102 via the second adhesive layer 120.

Figure 8:
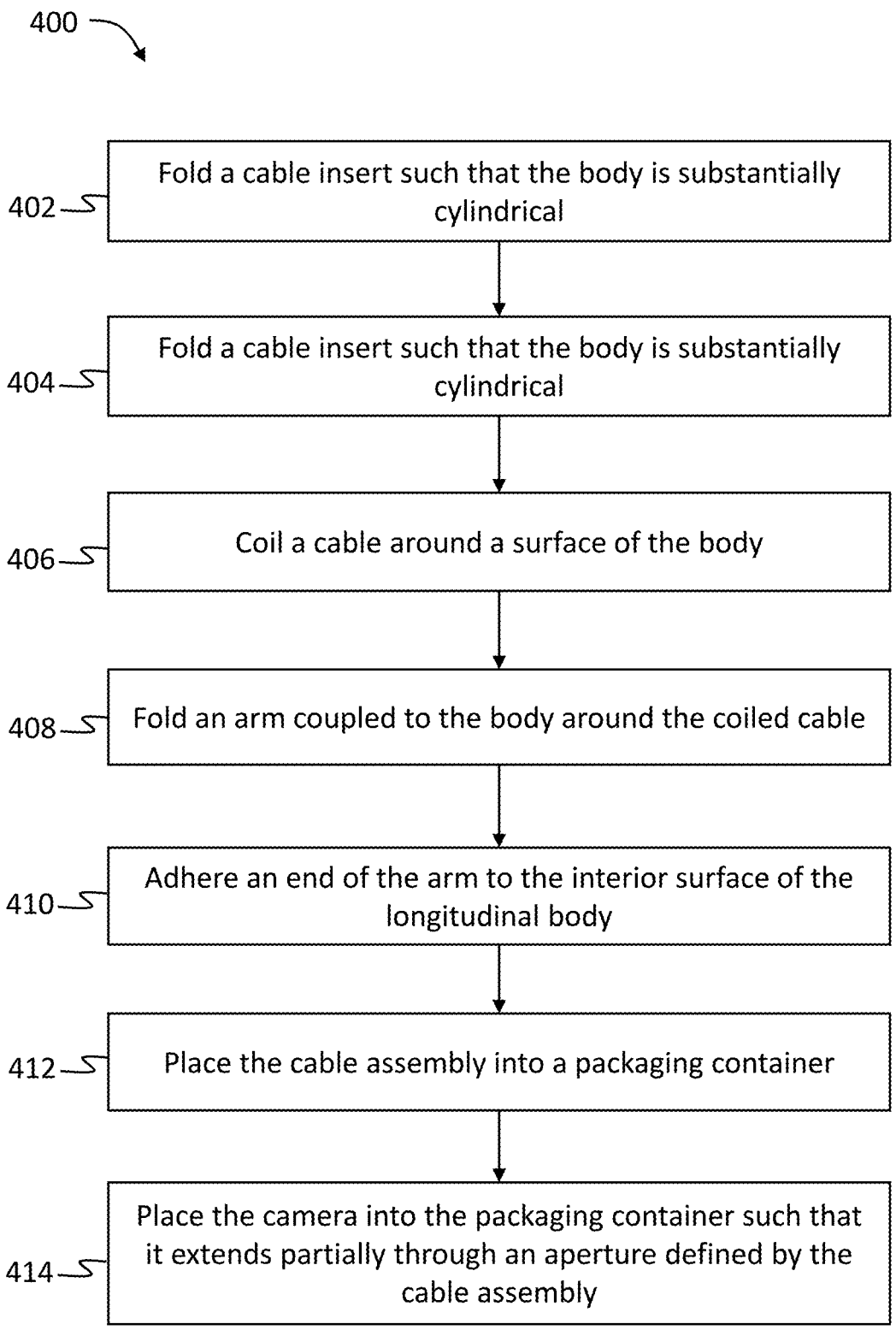
FIG. 8 is a flowchart illustrating a method of packaging a camera and cable assembly in accordance with the present disclosure.

Referring to FIG. 8, there is illustrated a method, generally designated 400, of packaging a camera and cable assembly in accordance with an exemplary example of the present disclosure. The method 400 may include steps 402 through 410 associated with forming a cable assembly. For example, performing the steps 402 to 410 may result in the cable assembly 10 shown in FIG. 1 being formed. The steps 402 through 410 are substantially the same as step 302 through 310 described above with regards to method 300 illustrated in FIG. 7 and for sake of brevity will not be described in further detail.

The method 400 may include the step 412 of placing the cable assembly into a packaging container. For example, the cable assembly 10 is placed into a packaging container 14 as illustrated in FIG. 4. The method 400 may include the step 414 of placing a camera into the packaging container such that it extends at least partially through an aperture defined by the cable assembly. For example, and as discussed above with regards to FIGS. 4-5, the product 16 (e.g., a camera 16) is placed into the packaging container 14 by positioning a portion of the camera 16 within the aperture 110 defined by the cable assembly 10. In some examples, the method 400 further includes closing and/or sealing the packaging container. For example, the packaging container 14 may be closed and/or sealed following placement of the product 16 therein.

The present disclosure further includes the following examples:

Example 1—a cable wrapping device comprising: a body including opposed terminal edges and a first adhesive layer disposed on a portion of the body proximate one of the opposed terminal edges thereof; and an arm positioned between the opposed terminal edges of the body and extending in a lateral direction away from the body, the arm including a second adhesive layer disposed on the arm proximate a terminal end of the arm.

Example 2—the cable wrapping device of example 1, wherein the arm has a width as measured in the lateral direction that is at least twice a width of the body.

Example 3—the cable wrapping device of any one of examples 1-2, wherein the arm extends laterally from a top edge of the body and a flap aligned with the arm extends laterally away from a bottom edge of the body.

Example 4—the cable wrapping device of any one of examples 1-3, wherein the body and the arm are integrally formed.

Example 5—the cable wrapping device of any one of examples 1-4, wherein the arm includes a pair of interlocking arms each including a slit extending partially along a length thereof and configured to enable the interlocking arms to interlock with one another.

Example 6—the cable wrapping device of any one of examples 1-5, wherein the body is comprised of a paperboard material.

Example 7—the cable wrapping device of any one of examples 1-6, wherein the arm has a width that is at least twice a width of the body.

Example 8—the cable wrapping device of any one of examples 1-7, wherein the body has a width of between about 40 mm to about 50 mm and a length of between about 200 mm to about 300 mm, and wherein the arm has a width of between about 80 mm to about 100 mm and a length of between about 10 mm to about 30 mm Example 9—the cable wrapping device of any one of examples 1-8, wherein the arm includes a plurality of arms individually coupled to and extending laterally away from the body, at least one the plurality of arms offset from one another in a longitudinal direction, and the second adhesive layer is disposed on a portion of each of the plurality of arms.

Example 10—a packaged cable assembly comprising: a cable wrapping device comprising: a body having a plurality of surfaces, and first and second terminal edges opposite one another, the one surface at the second terminal edge being adhered to another surface at the first terminal edge such that the body forms a cylindrical shape; and an arm positioned between the opposed first and second terminal edges and extending in a lateral direction away from the body; and a cable positioned around and at least partially abutting the body, wherein the arm wraps around the cable and such that a portion of the cable is positioned between the arm and the body and the arm is adhered to the body.

Example 11—the packaged cable assembly of example 10, wherein the cable is a power cable.

Example 12—the packaged cable assembly of any one of examples 10-11, wherein an inner surface of the body defines a sidewall of an aperture that extends circumferentially about a lateral axis.

Example 13—the packaged cable assembly of any one of examples 10-12, wherein the body and arm are integrally formed.

Example 14—a method comprising: folding a cable wrapping device such that a body thereof forms a substantially cylindrical shape; adhering a portion of a surface of the body to another portion thereof; coiling a cable around one surface of the body; folding an arm that extends laterally from the body around the coiled cable such that the cable is positioned between the arm and the one surface of the body; and adhering an end of the folded arm to the body.

Example 15—the method of example 14 further comprising: folding a flap that extends laterally away from the body opposite the arm towards the arm, and wherein folding the arm around the coiled cable includes folding the arm around the folded flap.

Example 16—the method of any one of examples 14-15, wherein the arm is a first arm and the method further comprises: folding a second arm that extends laterally from the body around the coiled cable such that the cable is positioned between the second arm and the one surface of the body.

Example 17—the method of any one of examples 14-16 further comprising: folding a third arm that extends laterally from the body around the coiled cable such that the cable is positioned between the third arm and the one surface of the body, wherein the first arm, second arm and third arm are spaced from one another along the body.

Example 18—the method of any one of examples 14-17, wherein adhering a portion of a surface of the body to another portion thereof further includes adhering a portion of an exterior surface of the body at one end thereof to a portion of an inner surface of the body at an opposite end thereof.

Example 19—the method of any one of examples 14-18, wherein folding an arm around the coiled cable further includes folding the arm downward from a top edge of the body toward a bottom edge thereof at a front surface of the body and wrapping the arm around the bottom edge such that the end of the arm is positioned at an inner surface between the top and bottom edges.

Example 20—the method of any one of examples 14-19, wherein coiling the cable around one surface of the body includes coiling the cable around an outer surface of the body, and wherein adhering the end of the folded arm to the body includes adhering the end of the folded arm to the inner surface of the body opposite the outer surface.

Example 21—a cable wrapping device including a body including opposed terminal edges and a first adhesive layer disposed on a portion of the body proximate one of the opposed terminal edges thereof, and a pair of interlocking arms coupled to the body at opposed top and bottom edges thereof, the pair of interlocking arms including a slit extending partially along a length thereof to interlock the arms with one another.

The term "about" or "approximately" is used herein to provide literal support for the exact number that it precedes, as well as a number that is near to or approximately the number that the term precedes. In determining whether a number is near to or approximately a specifically recited number, the near or approximating unrecited number may be a number, which, in the context in which it is presented, provides the substantial equivalent of the specifically recited number. It should be appreciated that all numerical values and ranges disclosed herein are approximate values and ranges, whether "about" is used in conjunction therewith. It should also be appreciated that the term "about," as used herein, in conjunction with a numeral refers to a value that may be ±0.01% (inclusive), ±0.1% (inclusive), ±0.5% (inclusive), ±1% (inclusive) of that numeral, ±2% (inclusive) of that numeral, ±3% (inclusive) of that numeral, ±5% (inclusive) of that numeral, ±10% (inclusive) of that numeral, or ±15% (inclusive) of that numeral. It should further be appreciated that when a numerical range is disclosed herein, any numerical value falling within the range is also specifically disclosed.

It will be appreciated by those skilled in the art that changes could be made to the exemplary examples shown and described above without departing from the broad inventive concepts thereof. It is to be understood that the examples and claims disclosed herein are not limited in their application to the details of construction and arrangement of the components set forth in the description and illustrated in the drawings. Rather, the description and the drawings provide examples of the examples envisioned. The examples and claims disclosed herein are further capable of other examples and of being practiced and carried out in various ways.

Specific features of the exemplary examples may or may not be part of the claims and various features of the disclosed examples may be combined. Unless specifically set forth herein, the terms "a", "an" and "the" are not limited to one element but instead should be read as meaning "at least one". Finally, unless specifically set forth herein, a disclosed or claimed method should not be limited to the performance of their steps in the order written, and one skilled in the art can readily appreciate that the steps may be performed in any practical order.

What is claimed is:

1. A cable wrapping device comprising:

a body including opposed terminal edges and a first adhesive layer disposed on a portion of the body proximate one of the opposed terminal edges thereof, the body including a top edge extending between the opposed terminal edges in a longitudinal direction; and a plurality of arms and flaps disposed along the body, the arms positioned between the opposed terminal edges of the body and extending in a lateral direction, transverse to the longitudinal direction, away from the top edge of the body, at least one of the plurality including a second adhesive layer disposed on the at least one arm proximate a terminal end thereof, and the flaps extending laterally away from a bottom edge of the body and aligned with one arm of the plurality.

2. The cable wrapping device of claim 1, wherein individual arms of the plurality include a width as measured in the lateral direction that is at least twice a width of the body.

3. The cable wrapping device of claim 1, wherein the body and individual arms of the plurality are integrally formed.

4. The cable wrapping device of claim 1, wherein the body is comprised of a corrugated material.

5. The cable wrapping device of claim 1, wherein the body is comprised of a paperboard material.

6. The cable wrapping device of claim 1, wherein individual arms of the plurality include a width that is at least twice a width of the body and individual flaps of the plurality include a width that is less than the width of the body.

7. The cable wrapping device of claim 1, wherein the body has a width of between about 40 mm to about 50 mm and a length of between about 200 mm to about 300 mm, and wherein individual arms of the plurality include a width of between about 80 mm to about 100 mm and a length of between about 10 mm to about 30 mm.

8. The cable wrapping device of claim 1, wherein individual arms of the plurality being offset from one another in the longitudinal direction, and wherein the second adhesive layer is disposed on a portion of the individual arms of the plurality of arms.

9. The cable wrapping device of claim 1, wherein the body and the plurality of arms include an outer surface upon which the first and second adhesive layers are disposed.

10. The cable wrapping device of claim 9, wherein an inner surface of the body and the plurality of arms is devoid of the first and second adhesive layers while the cable wrapping device is in a flat configuration.

11. The cable wrapping device of claim 10, wherein while the cable wrapping device is in a use configuration the first adhesive layer and the second adhesive layer are adhered to the inner surface of the body to secure a cable therein.

12. A device comprising:

a body including opposed terminal edges and a first adhesive layer disposed on a portion of the body proximate one of the opposed terminal edges thereof, the body including a top edge extending between the opposed terminal edges in a longitudinal direction; and a plurality of arms and flaps disposed along the body and integrally formed therewith, the arms positioned between the opposed terminal edges of the body and extending in a lateral direction, transverse to the longitudinal direction, away from a top edge of the body, at least one of the plurality including a second adhesive layer disposed on the at least one arm proximate a terminal end thereof, and the flaps extending laterally away from a bottom edge of the body and aligned with one arm of the plurality, and wherein the arms include a width that is at least twice a width of the body and the flaps include a width that is less than the width of the body.

13. The device of claim 12, wherein the body includes a width of between about 40 mm to about 50 mm and a length of between about 200 mm to about 300 mm, individual arms of the plurality of arms include a width of between about 80 mm to about 100 mm and a length of between about 10 mm to about 30 mm, and individual flaps of the plurality include a width of between about 5 mm to about 15 mm.

14. The device of claim 12, wherein the body is a corrugated material.

15. The device of claim 12, wherein the body is a paperboard material.

16. The device of claim 12, wherein the body and the plurality of arms include and an outer surface upon which the first and second adhesive layers are disposed.

17. The device of claim 16, wherein an inner surface of the body and the plurality of arms is devoid of the first and second adhesive layers while the device is in a flat configuration.

18. The device of claim 17, wherein while the device is in a use configuration the first adhesive layer and the second adhesive layer are adhered to the inner surface of the body.

* * * * *